US007607322B1

(12) United States Patent
Pernick

(10) Patent No.: US 7,607,322 B1
(45) Date of Patent: Oct. 27, 2009

(54) CIRCULAR KNITTING MACHINE WITH SINKER CAMS FACILITATING HIGH-SPEED OPERATION

(75) Inventor: Bruce Pernick, Stamford, CT (US)

(73) Assignee: Monarch Knitting Machinery Corp., Bronx, NY (US)

( * ) Notice: Subject to any disclaimer, the term of this patent is extended or adjusted under 35 U.S.C. 154(b) by 0 days.

(21) Appl. No.: 12/336,605

(22) Filed: Dec. 17, 2008

(51) Int. Cl.
*D04B 15/06* (2006.01)

(52) U.S. Cl. ..... 66/107; 66/93

(58) Field of Classification Search ..... 66/91–93, 66/107, 108 R, 57, 78
See application file for complete search history.

(56) References Cited

U.S. PATENT DOCUMENTS

| | | | | |
|---|---|---|---|---|
| 1,097,733 | A * | 5/1914 | Scott | 66/19 |
| 1,137,561 | A * | 4/1915 | Williams | 66/19 |
| 3,173,277 | A * | 3/1965 | Fregeolle | 66/107 |
| 3,331,219 | A * | 7/1967 | Brook | 66/93 |
| 4,020,653 | A | 5/1977 | Mischon et al. | |
| 4,037,434 | A | 7/1977 | Durville et al. | |
| 4,040,276 | A * | 8/1977 | Koegel | 66/107 |
| 4,137,728 | A | 2/1979 | Durville | |
| 4,920,767 | A | 5/1990 | Plath et al. | |
| 5,048,313 | A * | 9/1991 | Vignoni | 66/141 |
| 5,138,848 | A | 8/1992 | Schnurrer et al. | |
| 5,243,839 | A | 9/1993 | DiGiuseppe et al. | |
| 5,279,133 | A | 1/1994 | Plath | |
| 5,426,957 | A | 6/1995 | Yamaoka | |
| 5,613,375 | A | 3/1997 | Renda et al. | |
| 6,519,978 | B2 | 2/2003 | Pernick et al. | |

* cited by examiner

*Primary Examiner*—Danny Worrell
(74) *Attorney, Agent, or Firm*—Alston & Bird LLP

(57) ABSTRACT

A sinker cam ring for a circular knitting machine comprises a plurality of sinker cam segments arranged edge-to-edge to form the sinker cam ring, each sinker cam segment defining a portion of a sinker cam track that defines sinker-advancing and sinker-retracting surfaces. Breaks between adjacent sinker cam segments are located in linear portions of at least one of the sinker-advancing surfaces and sinker-retracting surfaces where substantially only frictional forces act on the sinkers, and thus where radial acceleration of the sinkers caused by the cam surfaces is substantially zero. The breaks for a given sinker cam segment can be circumferentially staggered relative to each other.

15 Claims, 4 Drawing Sheets

CIRCULAR KNITTING MACHINE WITH SINKER CAMS FACILITATING HIGH-SPEED OPERATION

BACKGROUND OF THE INVENTION

The present disclosure relates generally to circular knitting machines having needles and sinkers that cooperate to form stitch loops. The disclosure relates more particularly to circular knitting machines having sinkers whose movements are controlled by sinker cam segments that make up a sinker cam ring.

FIG. 1 depicts an example of two adjacent sinker cam segments 10, 20 making up part of a sinker cam ring in accordance with the state of the art existing prior to the present invention. The sinker cam segments 10, 20 define part of a sinker cam track 30 that is engaged by a portion (e.g., a butt) of each sinker. The sinkers are carried by the rotating cylinder of the machine, and the portions of the sinkers engaged in the cam track 30 move along the track as indicated by arrow A in FIG. 1. The sinker cam track 30 defines sinker cam surfaces 32 that control the inward (advancing) and outward (retracting) movements of the sinkers. More particularly, the sinker cam surfaces 32 include sinker-advancing surfaces 34 that cause the sinkers to be advanced radially inwardly, and sinker-retracting surfaces 36 that cause the sinkers to be retracted radially outwardly. As illustrated, it is common for the sinker cam ring to be formed of a plurality of sinker cam segments, two of which are shown in FIG. 1. Each of the sinker cam segments 10, 20 includes both a sinker-advancing surface 34 and a sinker-retracting surface 36. The joints or "breaks" between adjacent segments 10, 20 are located at the crests of the sinker cam surfaces 32. As a sinker travels along the cam track 30, the sinker must transition from one segment to the next, and thus must pass over the breaks between segments.

BRIEF SUMMARY OF THE DISCLOSURE

One significant drawback of this arrangement is that the breaks are located in acceleration areas of the sinker's movement where the sinker's momentum in the radial direction has to be stopped and reversed in direction. It would be desirable for the cam surfaces in the acceleration areas to be smooth and continuous, particularly for high-speed machines.

Additionally, locating the breaks at the acceleration areas generally requires the inclusion of a substantially linear portion or "flat" 38 at each crest and valley, to allow for as smooth a transfer between cam segments as possible. The result of including these flats 38 is that there is less circumferential distance available for accomplishing the needed radial travel of the sinkers. Consequently, the angles of the cam-advancing surfaces 34 and cam-retracting surfaces 36 must be increased, relative to what they could be if there were no flats present.

In accordance with the present disclosure, such flats can be eliminated, and accordingly the angles of the cam surfaces can be reduced. In one embodiment of the present invention, a circular knitting machine comprises a cylinder, needle cams disposed about the cylinder and defining a cam track having cam surfaces, knitting needles having needle butts engaged in the cam track such that relative rotation between the cylinder and needle cams causes the needles to be raised and lowered by engagement between the cam surfaces and needle butts, and sinkers disposed about the cylinder, each of the sinkers having a first sinker butt. The machine includes a sinker cam ring disposed about the cylinder and defining a first sinker cam track having first working surfaces that include first sinker-advancing surfaces and first sinker-retracting surfaces. The first working surfaces are made up of linear portions and curved portions. The first sinker butts are engaged with the first sinker cam track such that relative rotation between the cylinder and sinker cam ring causes the sinkers to be advanced inwardly and retracted outwardly relative to the needles by engagement between the first working surfaces and first sinker butts.

In accordance with this embodiment of the invention, the sinker cam ring comprises a plurality of sinker cam segments arranged edge-to-edge to form the sinker cam ring, each sinker cam segment defining a portion of the first sinker cam track. There are breaks between adjacent sinker cam segments where the edges of the segments confront one another. For each sinker cam segment that has the breaks located in the working surfaces defined by that cam segment, the breaks are located in the linear portions of the working surfaces where substantially only frictional forces act on the sinkers and radial acceleration of the sinkers due to the working surfaces is substantially zero.

By locating the breaks between sinker cam segments at the linear portions of the sinker-advancing surfaces and/or sinker-retracting surfaces, the sinkers can easily and smoothly traverse the breaks because they are not being radially accelerated during the transition between segments, which is a problem with the prior-art sinker cam arrangements (particularly at high speeds). Furthermore, the angles of the working surfaces are reduced relative to the above-described prior art arrangement, and thus the accelerations required in order to bring the sinkers to a halt and reverse their movement in the radial direction are reduced relative to the prior-art arrangement. These features facilitate high-speed operation of the knitting machine.

The sinker cam ring can define a single cam track. Alternatively, in other embodiments, the sinker cam ring can define multiple cam tracks. For example, in one embodiment the sinker cam ring defines a second sinker cam track radially spaced from the first cam track and each of the sinkers further includes a second sinker butt engaged with the second sinker cam track. The second sinker cam track defines second working surfaces (second sinker-advancing and second sinker-retracting surfaces) made up of linear portions and curved portions. Each sinker cam segment defines a portion of the second sinker cam track. Breaks between adjacent sinker cam segments are located in the linear portions of the second working surfaces where substantially only frictional forces act on the sinkers and radial acceleration of the sinkers is substantially zero.

In one embodiment of the dual-track cam ring, there is a subset of the sinker cam segments in which each defines part of one of the first working surfaces and part of one of the second working surfaces and in which the break at the first working surface is circumferentially staggered relative to the break at the second working surface.

For example, in one dual-track embodiment, some of the sinker cam segments have the breaks in the sinker-advancing surfaces. For each of these sinker cam segments the break at the first sinker-advancing surface is circumferentially staggered relative to the break at the second sinker-advancing surface. Alternatively, if the breaks are in the sinker-retracting surfaces, the break at the first sinker-retracting surface can be circumferentially staggered relative to the break at the second sinker-retracting surface.

In either the single-track or multi-track cam embodiments, additional working surfaces can be provided by an additional sinker cam surface defined by the sinker cam segments. For example, the cam segments can define additional sinker-advancing surfaces radially spaced from the other sinker-advancing surfaces. Thus, in a single-track embodiment having the additional sinker-advancing surfaces, there are a total of three working surfaces (two sinker-advancing surfaces and one sinker-retracting surface). In a dual-track embodiment having the additional sinker-advancing surfaces, there are a total of five working surfaces (three sinker-advancing surfaces and two sinker-retracting surfaces). There can be staggered break points on one or more of the working surfaces in order to positively control the sinker on one surface while another portion of the sinker engaged with the sinker cam passes a break point but stays on the intended path, despite the discontinuity of that surface.

BRIEF DESCRIPTION OF THE SEVERAL VIEWS OF THE DRAWING(S)

Having thus described the invention in general terms, reference will now be made to the accompanying drawings, which are not necessarily drawn to scale, and wherein:

DETAILED DESCRIPTION OF THE DRAWINGS

The present invention now will be described more fully hereinafter with reference to the accompanying drawings in which some but not all embodiments of the inventions are shown. Indeed, these inventions may be embodied in many different forms and should not be construed as limited to the embodiments set forth herein; rather, these embodiments are provided so that this disclosure will satisfy applicable legal requirements. Like numbers refer to like elements throughout.

Figure 1:
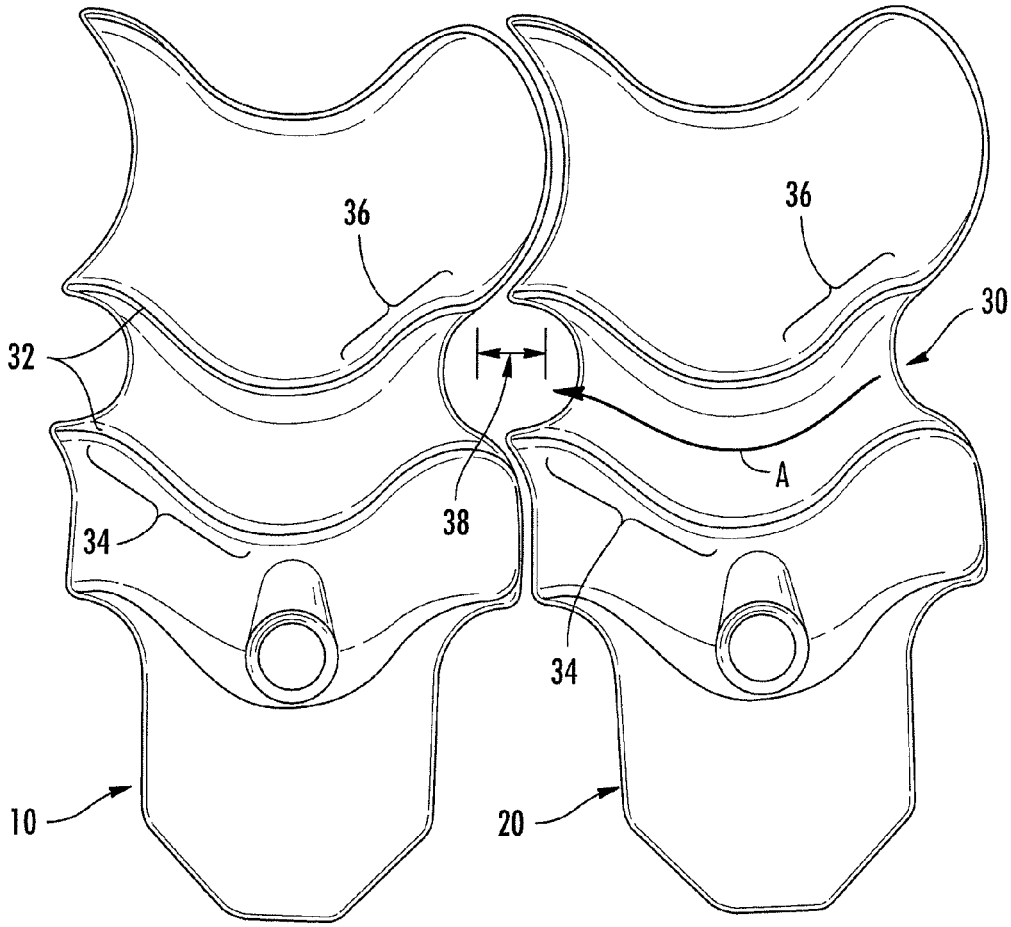
FIG. 1 PRIOR ART
FIG. 1 shows two adjacent sinker cam segments in accordance with the prior art.
Figure 2:
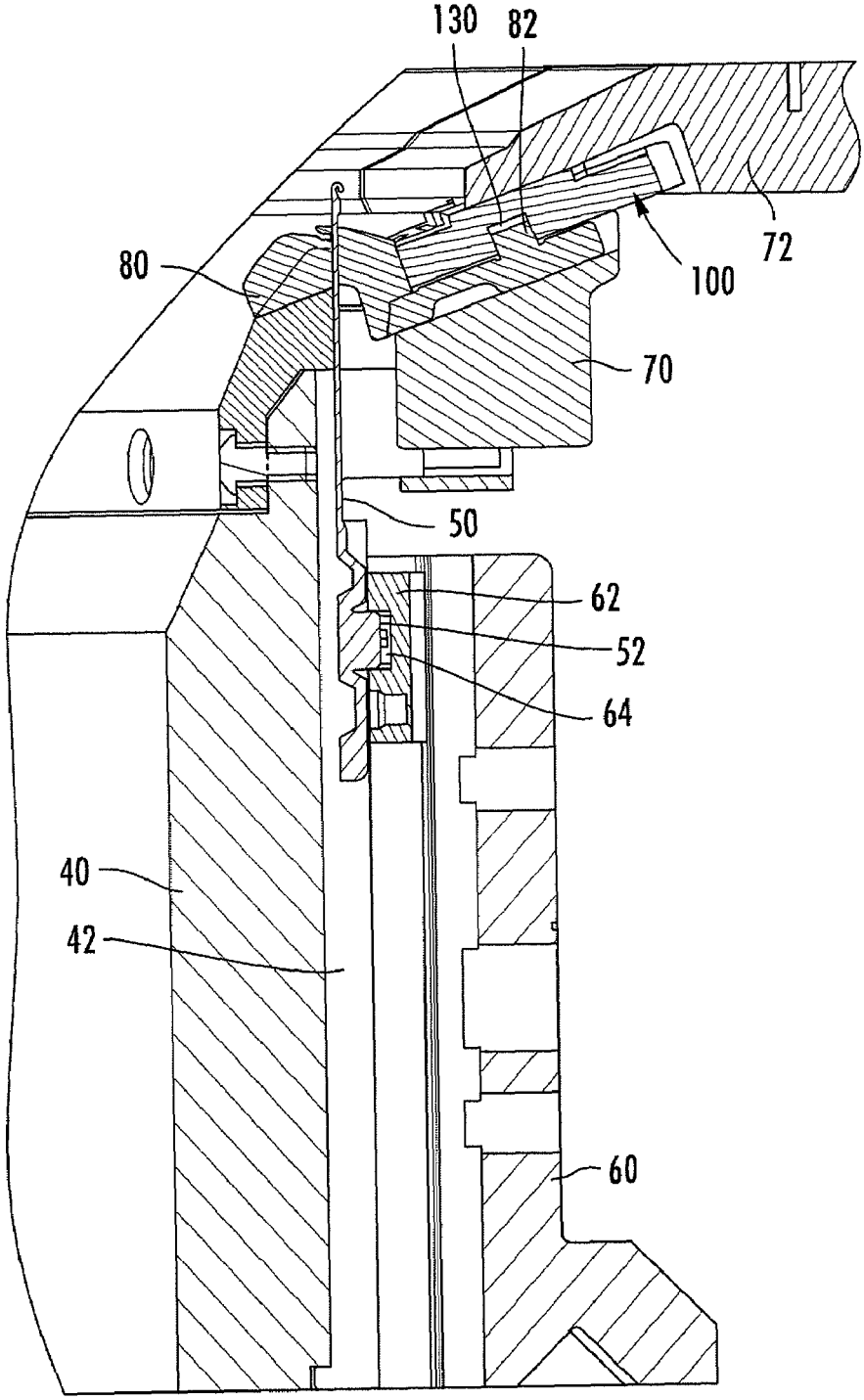
FIG. 2 is a cross-sectional view of a circular knitting machine in accordance with one embodiment of the invention.

FIG. 2 is cross-sectional view of a circular knitting machine in accordance with one embodiment of the present invention. The knitting machine includes a cylinder 40 that is rotatable about its central axis, which is oriented vertically. The cylinder 40 defines a plurality of vertical channels or tricks defined between circumferentially spaced, vertical trick walls 42 disposed at the outer peripheral surface of the cylinder. A needle 50 is disposed in each trick. Each needle has a butt 52 that projects radially outwardly. The machine includes a stationary cam box 60 that surrounds the cylinder 40. A plurality of needle cams 62 are mounted on the cam box and collectively define a needle cam track 64 in which the needle butts 52 are disposed. Rotation of the cylinder 40 about its axis carries the needles 50 about a circular path and the needle butts 52 travel along the need cam track 64. Cam surfaces defined by the needle cam track cause each of the needles to be raised and lowered in a fashion dictated by the shapes of the cam surfaces.

The circular knitting machine also includes a sinker trick ring 70 that is affixed to the outside top of the cylinder 40 and thus rotates with it. A stationary sinker cam cap 72 is mounted adjacent the sinker trick ring. A sinker cam ring 100 is mounted on the sinker cam cap 72. The sinker cam ring defines a sinker cam track 130. A plurality of sinkers 80 (generally one between every pair of adjacent needles 50) are carried by the sinker trick ring 70 and each is disposed in a sinker trick defined by the sinker trick ring. The sinkers are movable inwardly and outwardly, in a generally horizontal or radial direction, in their respective sinker tricks. In the illustrated embodiment, the sinkers are arranged to travel inwardly and outwardly along a direction that is not purely horizontal/radial, but rather is inclined relative to horizontal at an angle, such as approximately about 20°. However, throughout the present application, references to the sinkers moving or being accelerated "radially" will be understood to mean that the movement or acceleration has a radial component, but is not necessarily purely radial.

Each sinker has a butt 82 disposed in the sinker cam track 130. When the sinkers are carried about their circular path by rotation of the cylinder and hence rotation of the sinker trick ring, the sinker butts 82 travel along the sinker cam track 130. Working surfaces defined by the sinker cam track cause each of the sinkers to be advanced radially inwardly and retracted radially outwardly in a fashion dictated by the shapes of the working surfaces. The needles 50 and sinkers 80 cooperate to form stitch loops, as well known in the art.

Figure 3:
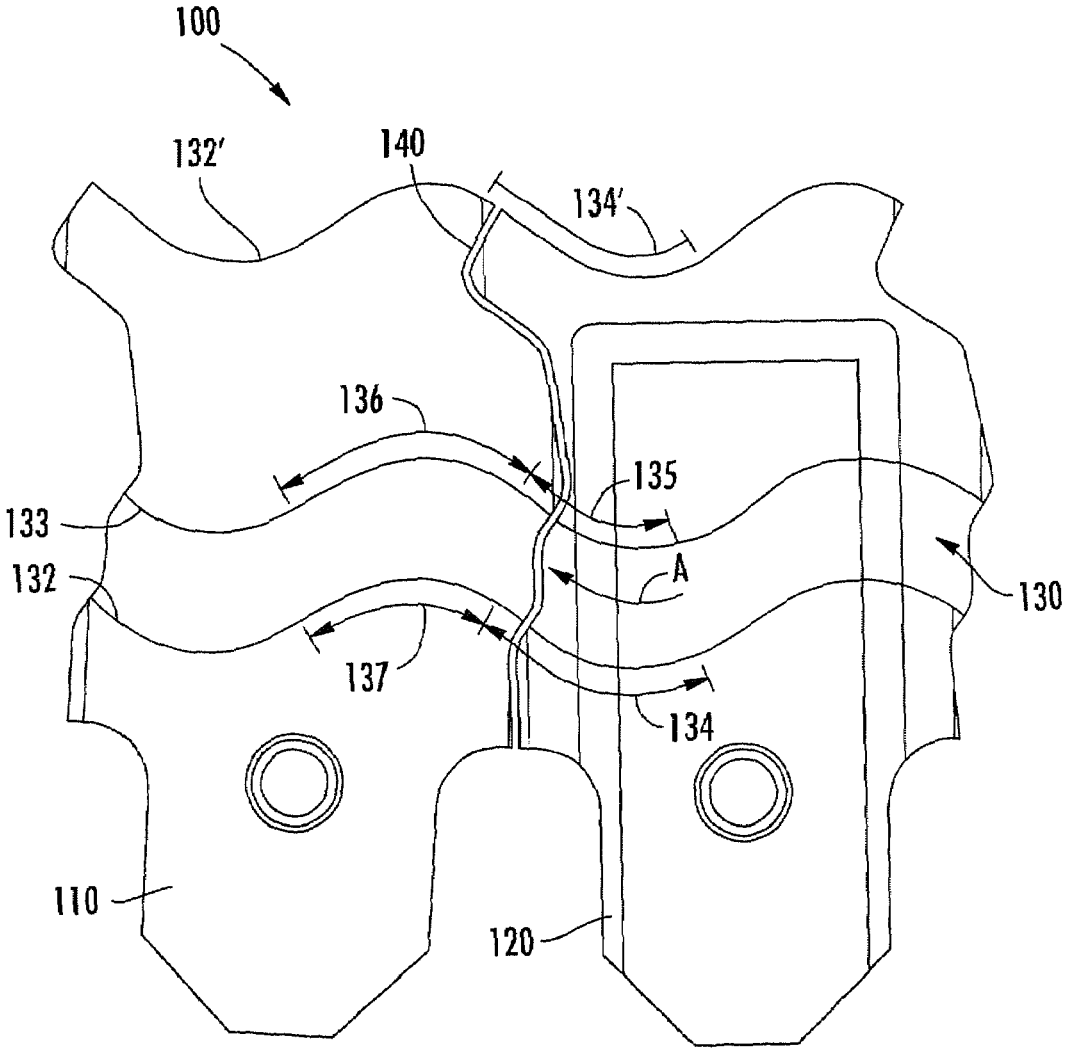
FIG. 3 shows two adjacent sinker cam segments in accordance with a single-track embodiment of the present invention.

With reference to FIG. 3 showing a sinker cam ring 100 in accordance with a first embodiment of the present invention, it will be noted that the sinker cam ring is made up of a plurality of sinker cam segments arranged edge-to-edge to form the ring. FIG. 3 shows two such sinker cam segments 110 and 120 that are adjacent each other in the ring. The sinker cam segments are mounted (e.g., by threaded fasteners, not shown) on the sinker cam cap 72 (FIG. 2). The sinker cam segments collectively define a sinker cam track 130 along which the sinker butts 82 travel in the direction indicated by arrow A. The surfaces of the cam track acting on the sinker butts cause the sinkers to be moved radially inwardly (generally toward the top of FIG. 3) and outwardly (generally toward the bottom of FIG. 3).

In the single-track embodiment of FIG. 3, the sinker cam track 130 is defined between two radially spaced surfaces 132 and 133 (referred to collectively herein as "first working surfaces") each of which has a generally undulating or wavy shape, the surface 132 being spaced radially outward from the surface 133. For advancing the sinkers 80 radially inwardly, the surface 132 defines working surfaces 134 while the surface 133 defines guarding surfaces 135. For retracting the sinkers radially outwardly, the surface 133 defines working surfaces 136 while the surface 132 defines guarding surfaces 137. The working surfaces impart the desired radial movement to the sinkers, while the guarding surfaces prevent the sinker butts from disengaging the working surfaces as a result of radial acceleration imparted by the working surfaces.

There is a break 140 between adjacent cam segments 110, 120. The break 140 is a small gap between adjacent edges of the segments. In accordance with the present invention, each of the breaks 140 that is located in any of the working surfaces is located at a linear portion of the working surface where essentially zero acceleration is being imparted to the sinkers by the working surfaces and thus only frictional forces are being exerted on the sinkers. For example, as shown in FIG. 3, the break 140 is located at a linear portion of the sinker-advancing working surface 134 and at a linear portion of the opposite guarding surface 135, while there are no breaks in the sinker-retracting working surfaces 136 or their opposite guarding surfaces 137. Alternatively, however, the breaks could be located in the sinker-retracting surfaces rather than in the sinker-advancing surfaces.

By locating the breaks 140 between sinker cam segments 110, 120 at the linear portions of the sinker-advancing surfaces and/or sinker-retracting surfaces, the sinkers can easily and smoothly traverse the breaks because they are not being radially accelerated by the working surfaces during the transition between segments. (It is recognized, of course, that the sinkers experience centripetal acceleration in the radial direction as a result of their rotation about the axis of the knitting machine, but this is relatively small in relation to the radial acceleration of interest in the present invention, which is the acceleration imparted on the sinkers by the working surfaces of the sinker cam segments.) Furthermore, the angles of the working surfaces are reduced relative to the above-described prior art arrangement, and thus the accelerations required in order to bring the sinkers to a halt and reverse their movement in the radial direction are reduced relative to the prior-art arrangement. These features facilitate high-speed operation of the knitting machine.

The sinker cam segments 110, 120 of the illustrated embodiment define an additional working surface 132' at the radially inner edges of the segments, which is engaged by another portion of the sinker 80. The surface 132' defines additional sinker-advancing working surfaces 134'. A given sinker simultaneously engages both of the sinker-advancing surfaces 134 and 134' on the cam segment 120. The break 140 in the additional sinker-advancing surface 134' is circumferentially staggered relative to the break 140 in the first sinker-advancing surface 134. More generally, for each cam segment in the cam ring that defines two radially spaced working surfaces (either two sinker-advancing or two sinker-retracting surfaces) that are simultaneously engaged by a given sinker, the breaks in such working surfaces are circumferentially staggered relative to each other. These staggered break points on the working surfaces help to positively control the sinker on one surface (e.g., on surface 134') while another portion of the sinker passes the break 140 on the other working surface (e.g., surface 134) such that the sinker stays on the intended path despite the discontinuity of that surface.

Figure 4:
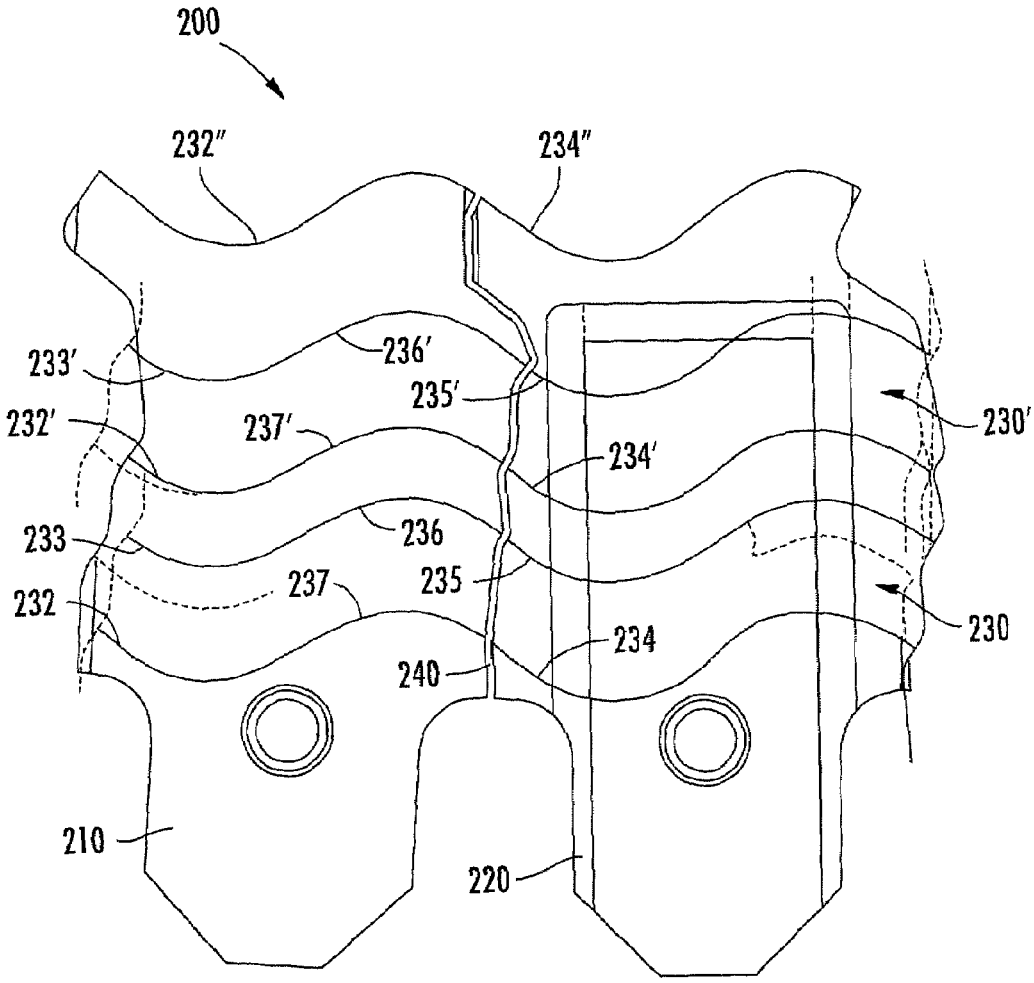
FIG. 4 shows two adjacent sinker cam segments in accordance with a dual-track embodiment of the present invention.

A dual-track cam ring 200 in accordance with another embodiment of the invention is shown in FIG. 4. The cam segments 210, 220 collectively define two sinker cam tracks 230, 230' that are radially spaced apart and are engaged by two spaced butts formed on each of the sinkers 80'. The first track 230 is defined between first sinker cam surfaces 232 and 233. The second track 230' similarly is defined between second working surfaces 232' and 233'. For advancing the sinkers 80' radially inwardly, the working surfaces 232, 232' respectively define sinker-advancing working surfaces 234, 234' while the surfaces 233, 233' define guarding surfaces 235, 235'. For retracting the sinkers radially outwardly, the working surfaces 233, 233' respectively define sinker-retracting working surfaces 236, 236' while the surfaces 232, 232' define guarding surfaces 237, 237'. The working surfaces impart the desired radial movement to the sinkers, while the guarding surfaces prevent the sinker butts from disengaging the working surfaces as a result of radial acceleration imparted by the working surfaces. The cam segments also define an additional sinker cam surface 232" at the inner edges of the segments, which surface defines a third sinker-advancing working surface 234". Accordingly, in this embodiment, there are three sinker-advancing surfaces two of which have corresponding guarding surfaces, and two sinker-retracting surfaces with two corresponding guarding surfaces.

The break 240 between adjacent cam segments 210, 220 is located with respect to the cam surfaces 232, 233, 232', 233', 232" such that the break is at a linear portion of each surface where essentially zero radial acceleration is being imparted to the sinkers and thus only frictional forces are being exerted on the sinkers. For example, as shown in FIG. 3, the break 240 is located at a linear portion of each of the sinker-advancing working surfaces 234, 234' and the opposite guarding surfaces 235, 235', while there are no breaks in the sinker-retracting working surfaces 236, 236' or their opposite guarding surfaces 237, 237'. Alternatively, however, the breaks could be located in the sinker-retracting surfaces rather than in the sinker-advancing surfaces.

The breaks 240 at the working surfaces 234, 234', 234" of cam segment 220 are circumferentially staggered with respect to one another in the illustrated embodiment. Similarly, the breaks 240 at the guarding surfaces 235, 235' are circumferentially staggered with respect to each other.

Many modifications and other embodiments of the inventions set forth herein will come to mind to one skilled in the art to which these inventions pertain having the benefit of the teachings presented in the foregoing descriptions and the associated drawings. For example, while the sinker cam rings illustrated herein have female cam tracks engaged by male sinker butts, it is well known in the art that alternatively the sinker cam tracks can comprise male elements that engage female elements in the sinkers. Accordingly, it will be understood that the term "sinker butt" as used herein is not limited to a male element on the sinker, but can also refer to a female element in the sinker. Other modifications can also be made to the embodiments shown herein. Therefore, it is to be understood that the inventions are not to be limited to the specific embodiments disclosed and that modifications and other embodiments are intended to be included within the scope of the appended claims. Although specific terms are employed herein, they are used in a generic and descriptive sense only and not for purposes of limitation.

What is claimed is:

1. A circular knitting machine, comprising:

a cylinder;

needle cams disposed about the cylinder and defining a cam track having cam surfaces;

knitting needles having needle butts engaged in the cam track such that relative rotation between the cylinder and needle cams causes the needles to be raised and lowered by engagement between the cam surfaces and needle butts;

sinkers disposed about the cylinder, each of the sinkers having a first sinker butt;

a sinker cam ring disposed about the cylinder and comprising a plurality of sinker cam segments arranged edge-to-edge to form the sinker cam ring, the sinker cam ring defining a first sinker cam track having first working surfaces that include first sinker-advancing surfaces and first sinker-retracting surfaces, the first working surfaces being made up of linear portions and curved portions, the first sinker butts being engaged with the first sinker cam track such that relative rotation between the cylinder and sinker cam ring causes the sinkers to be advanced inwardly and retracted outwardly relative to the needles by engagement between the first working surfaces and first sinker butts;

wherein for each sinker cam segment that has the breaks located in the working surfaces defined by said cam segment, said breaks are located in the linear portions of the first sinker-advancing surfaces and/or first sinker-retracting surfaces, where substantially only frictional forces act on the sinkers and radial acceleration of the sinkers caused by the working surfaces is substantially zero.

2. The circular knitting machine of claim 1, wherein the sinker cam ring defines a second sinker cam track radially spaced from the first sinker cam track and each of the sinkers further includes a second sinker butt engaged with the second sinker cam track, the second sinker cam track defining second working surfaces including second sinker-advancing surfaces and second sinker-retracting surfaces, the second working surfaces being made up of linear portions and curved portions, each sinker cam segment defining a portion of the second sinker cam track, and wherein breaks between adjacent sinker cam segments are located in the linear portions of the second sinker-advancing surfaces and/or second sinker-retracting surfaces, where substantially only frictional forces act on the sinkers and radial acceleration of the sinkers caused by the second working surfaces is substantially zero.

3. The circular knitting machine of claim 2, wherein there is a subset of the sinker cam segments in which each defines part of one of the first working surfaces and part of one of the second working surfaces and in which the break at the first working surface is circumferentially staggered relative to the break at the second working surface.

4. The circular knitting machine of claim 3, wherein said subset of the sinker cam segments has the breaks located in the first and second sinker-advancing surfaces.

5. The circular knitting machine of claim 1, wherein the sinker cam segments define an additional sinker cam surface defining additional working surfaces radially spaced from the first working surfaces, and wherein each of the sinkers includes an additional portion that engages the additional working surfaces, the breaks at the additional working surfaces being located in linear portions of the additional working surfaces.

6. The circular knitting machine of claim 5, wherein the breaks at the additional working surfaces are circumferentially staggered with respect to the breaks at the first working surfaces.

7. A sinker cam ring for a circular knitting machine, comprising a plurality of sinker cam segments arranged edge-to-edge to form the sinker cam ring, the sinker cam ring defining a first sinker cam track having first working surfaces that include first sinker-advancing surfaces and first sinker-retracting surfaces for engaging first sinker butts of sinkers, the first sinker-advancing surfaces and first sinker-retracting surfaces being made up of linear portions and curved portions, each sinker cam segment defining a portion of the first sinker cam track, and wherein breaks between adjacent sinker cam segments are located in the linear portions of the sinker-advancing surfaces and/or first sinker-retracting surfaces, where substantially only frictional forces act on the sinkers and radial acceleration of the sinkers caused by the first working surfaces is substantially zero.

8. The sinker cam ring of claim 7, wherein the sinker cam ring defines a second sinker cam track radially spaced from the first sinker cam track and defining second working surfaces including second sinker-advancing surfaces and second sinker-retracting surfaces for engaging second sinker butts of the sinkers, the second working surfaces being made up of linear portions and curved portions, each sinker cam segment defining a portion of the second sinker cam track, and wherein breaks between adjacent sinker cam segments are located in the linear portions of the second sinker-advancing surfaces and/or second sinker-retracting surfaces, where substantially only frictional forces act on the sinkers and radial acceleration of the sinkers caused by the second working surfaces is substantially zero.

9. The sinker cam ring of claim 8, wherein there is a subset of the sinker cam segments in which each defines part of one of the first working surfaces and part of one of the second working surfaces and in which the break at the first working surface is circumferentially staggered relative to the break at the second working surface.

10. The sinker cam ring of claim 9, wherein said subset of the sinker cam segments has the breaks located in the first and second sinker-advancing surfaces.

11. The sinker cam ring of claim 7, wherein the sinker cam segments define an additional sinker cam surface defining additional working surfaces radially spaced from the first working surfaces, and wherein each of the sinkers includes an additional portion that engages the additional working surfaces, the breaks at the additional working surfaces being located in linear portions of the additional working surfaces.

12. The sinker cam ring of claim 11, wherein the breaks at the additional working surfaces are circumferentially staggered with respect to the breaks at the first working surfaces.

13. A sinker cam ring for a circular knitting machine, comprising a plurality of sinker cam segments arranged edge-to-edge to form the sinker cam ring, the sinker cam ring defining a first sinker cam track having first working surfaces including first sinker-advancing surfaces and first sinker-retracting surfaces, the sinker cam segments further defining an additional sinker cam surface radially spaced from the first sinker cam surfaces, the additional sinker cam surface defining additional working surfaces, each sinker cam segment defining a portion of the first sinker cam track and a portion of the additional sinker cam surface, there being breaks in the first working surfaces and in the additional working surfaces where opposing edges of the sinker cam segments confront one another, and wherein the breaks in the additional working surfaces are circumferentially staggered relative to the breaks in the first working surfaces.

14. The sinker cam ring of claim 13, wherein the breaks in the first working surfaces and the breaks in the additional working surfaces are located in linear portions of said surfaces where substantially only frictional forces act on sinkers engaged with said surfaces and radial acceleration of the sinkers caused by said surfaces is substantially zero.

15. A sinker cam ring for a circular knitting machine, the sinker cam ring comprising a plurality of sinker cam segments arranged edge-to-edge to form the sinker cam ring, the sinker cam ring defining first and second sinker-advancing surfaces that are radially spaced apart and located such that a given sinker simultaneously engages both the first and second sinker-advancing surfaces, there being breaks in both the first and second sinker-advancing surfaces where opposing edges of the adjacent sinker cam segments confront one another, and wherein the breaks in the first sinker-advancing surfaces are circumferentially staggered relative to the breaks in the second sinker-advancing surfaces.

* * * * *

UNITED STATES PATENT AND TRADEMARK OFFICE

CERTIFICATE OF CORRECTION

PATENT NO. : 7,607,322 B1
APPLICATION NO. : 12/336605
DATED : October 27, 2009
INVENTOR(S) : Pernick It is certified that error appears in the above-identified patent and that said Letters Patent is hereby corrected as shown below:

Column 7,

Line 43, "the sinker-advancing" should read --the first sinker-advancing--.

Signed and Sealed this

Twenty-third Day of November, 2010

David J. Kappos

David J. Kappos
*Director of the United States Patent and Trademark Office*